US012742375B2

(12) United States Patent
Kabrich et al.

(10) Patent No.: US 12,742,375 B2
(45) Date of Patent: Sep. 22, 2026

(54) HYBRID POWERTRAIN FOR A PUMP SYSTEM

(71) Applicant: Caterpillar Inc., Peoria, IL (US)

(72) Inventors: Todd Ryan Kabrich, Tomball, TX (US); Sri Harsha Uddanda, Cypress, TX (US); John M. Tanner, Dunlap, IL (US); Yuesheng He, Sugar Land, TX (US)

(73) Assignee: Caterpillar Inc., Peoria, IL (US)

( * ) Notice: Subject to any disclaimer, the term of this patent is extended or adjusted under 35 U.S.C. 154(b) by 307 days.

(21) Appl. No.: 18/308,381

(22) Filed: Apr. 27, 2023

(65) Prior Publication Data

US 2024/0360747 A1 Oct. 31, 2024

(51) Int. Cl.

| | |
|---|---|
| ***E21B 43/26*** | (2006.01) |
| ***F04B 17/03*** | (2006.01) |
| ***F04B 17/05*** | (2006.01) |
| ***F04B 49/20*** | (2006.01) |

(52) U.S. Cl.

CPC ..... *E21B 43/2607* (2020.05); *F04B 17/03* (2013.01); *F04B 17/05* (2013.01); *F04B 49/20* (2013.01); *F04B 2203/0207* (2013.01); *F04B 2203/0603* (2013.01)

(58) Field of Classification Search

CPC ..... E21B 43/2607; F04B 17/03; F04B 17/05; F04B 49/20; F04B 2203/0207; F04B 2203/0603

See application file for complete search history.

(56) References Cited

U.S. PATENT DOCUMENTS

| | | | | |
|---|---|---|---|---|
| 6,708,787 | B2 * | 3/2004 | Naruse | E02F 9/2217 903/903 |
| 7,086,226 | B2 * | 8/2006 | Oguri | E02F 9/2246 60/436 |
| 7,900,724 | B2 * | 3/2011 | Promersberger | B60K 25/06 180/53.4 |
| 9,579,980 | B2 * | 2/2017 | Cryer | B60K 6/485 |
| 9,752,384 | B2 * | 9/2017 | Gard | E21B 3/02 |
| 2013/0232964 | A1 * | 9/2013 | Nielsen | F04B 23/04 60/486 |

(Continued)

FOREIGN PATENT DOCUMENTS

| | | | | |
|---|---|---|---|---|
| CN | 114508470 A | * | 5/2022 | F04B 49/00 |
| JP | 2004084470 A | * | 3/2004 | E02F 9/2246 |

(Continued)

*Primary Examiner* — Alexander B Comley

(57) ABSTRACT

A pump system may include a hybrid powertrain that includes a gaseous fuel engine, a transmission coupled to the gaseous fuel engine, a driveshaft coupled to the transmission, a hydraulic fracturing pump coupled to the driveshaft, and a motor system coupled to the hydraulic fracturing pump. The pump system may include a power source electrically connected to the motor system. The pump system may include a controller configured to determine a torque distribution between the gaseous fuel engine and the motor system based at least in part on whether a transient event is associated with the pump system, and cause the gaseous fuel engine and the motor system to operate according to the torque distribution such that the motor system assists or brakes the gaseous fuel engine in driving the hydraulic fracturing pump.

13 Claims, 8 Drawing Sheets

(56) References Cited

U.S. PATENT DOCUMENTS

| | | | | |
|---|---|---|---|---|
| 2015/0175013 | A1* | 6/2015 | Cryer | B60K 1/04 290/1 A |
| 2016/0244053 | A1* | 8/2016 | Hartz | B60W 20/40 |
| 2017/0291712 | A1* | 10/2017 | Himmelmann | B64D 27/33 |
| 2019/0162061 | A1* | 5/2019 | Stephenson | H01M 8/0662 |
| 2020/0040878 | A1* | 2/2020 | Morris | E21B 43/2607 |
| 2020/0224645 | A1* | 7/2020 | Buckley | F04B 9/045 |
| 2021/0095648 | A1* | 4/2021 | Buckley | F04B 9/02 |
| 2021/0230987 | A1* | 7/2021 | Tanner | F04B 17/00 |
| 2021/0301815 | A1* | 9/2021 | Chretien | F04B 51/00 |
| 2021/0396121 | A1* | 12/2021 | Wilson | F04B 9/02 |
| 2022/0018234 | A1* | 1/2022 | Reddy | F04B 23/04 |
| 2022/0381125 | A1* | 12/2022 | Wilson | F04D 13/12 |
| 2023/0340866 | A1* | 10/2023 | Aune | F04B 17/03 |

FOREIGN PATENT DOCUMENTS

| | | | | |
|---|---|---|---|---|
| WO | WO-2018044323 | A1 * | 3/2018 | F04B 17/06 |
| WO | WO-2020214934 | A1 * | 10/2020 | F04B 49/06 |
| WO | WO-2020219091 | A1 * | 10/2020 | F02C 6/00 |
| WO | WO-2021030048 | A1 * | 2/2021 | E21B 43/2607 |

* cited by examiner

HYBRID POWERTRAIN FOR A PUMP SYSTEM

TECHNICAL FIELD

The present disclosure relates generally to fluid pumps and, for example, to a hybrid powertrain for a pump system.

BACKGROUND

Hydraulic fracturing is a well stimulation technique that typically involves pumping hydraulic fracturing fluid into a wellbore at a rate and a pressure (e.g., up to 15,000 pounds per square inch (psi)) sufficient to form fractures in a rock formation surrounding the wellbore. This well stimulation technique often enhances the natural fracturing of a rock formation to increase the permeability of the rock formation, thereby improving recovery of water, oil, natural gas, and/or other fluids. A pump used for a hydraulic fracturing operation is typically driven by a diesel internal combustion engine. A diesel engine is responsive enough to provide the necessary transient power during hydraulic fracturing operations, but can be expensive to operate.

Gaseous fuels, such as natural gas, may be less expensive than other hydrocarbon fuels, more readily available in remote areas, and may burn relatively cleaner during operation. A typical gaseous fuel internal combustion engine differs from a traditional, liquid fuel internal combustion engine primarily in that a gaseous fuel (e.g., methane, natural gas, ethane, and/or propane) is burned in the engine rather than an atomized mist of liquid fuel from a fuel injector or carburetor. Most gaseous fuel engines operate using spark ignition by a conventional spark plug. While gaseous fuel engines have a number of benefits, gaseous fuel engines are typically associated with poor transient response characteristics (e.g., in connection with fluctuating load demands). This is because a gaseous fuel engine may be associated with a relatively long path between cylinders of the engine and a fuel inlet to the engine. Thus, it may take several seconds before a volume of gaseous fuel in the engine can be adjusted to a new level.

The pump system of the present disclosure solves one or more of the problems set forth above and/or other problems in the art.

SUMMARY

A pump system may include a hybrid powertrain that includes a gaseous fuel engine, a transmission coupled to the gaseous fuel engine, a driveshaft coupled to the transmission, a hydraulic fracturing pump coupled to the driveshaft, and a motor system coupled to the hydraulic fracturing pump. The pump system may include a power source electrically connected to the motor system. The pump system may include a controller configured to determine a torque distribution between the gaseous fuel engine and the motor system based at least in part on whether a transient event is associated with the pump system, and cause the gaseous fuel engine and the motor system to operate according to the torque distribution such that the motor system assists or brakes the gaseous fuel engine in driving the hydraulic fracturing pump.

A controller may include one or more memories, and one or more processors configured to detect a transient event associated with a pump system that includes a hybrid powertrain having an engine, a transmission coupled to the engine, a driveshaft coupled to the transmission, a hydraulic fracturing pump coupled to the driveshaft, and a motor system coupled to the hydraulic fracturing pump. The one or more processors may be configured to determine a torque distribution between the engine and the motor system to be used during the transient event. The one or more processors may be configured to cause the motor system to operate according to the torque distribution to assist or to brake the engine in driving the hydraulic fracturing pump during the transient event.

A method may include determining whether a hybrid powertrain of a pump system is to use a hybrid mode, the hybrid powertrain including a gaseous fuel engine, a transmission coupled to the gaseous fuel engine, a driveshaft coupled to the transmission, a hydraulic fracturing pump coupled to the driveshaft, and a motor system coupled to the hydraulic fracturing pump. The method may include determining, based on a determination that the hybrid powertrain is to use the hybrid mode, a torque distribution between the gaseous fuel engine and the motor system. The method may include causing the gaseous fuel engine and the motor system to operate according to the torque distribution such that the motor system assists or brakes the gaseous fuel engine in driving the hydraulic fracturing pump.

DETAILED DESCRIPTION

This disclosure relates to a control system, which is applicable to any machine or system that uses a reciprocating engine, such as a gaseous fuel engine, associated with poor transient response.

Figure 1:
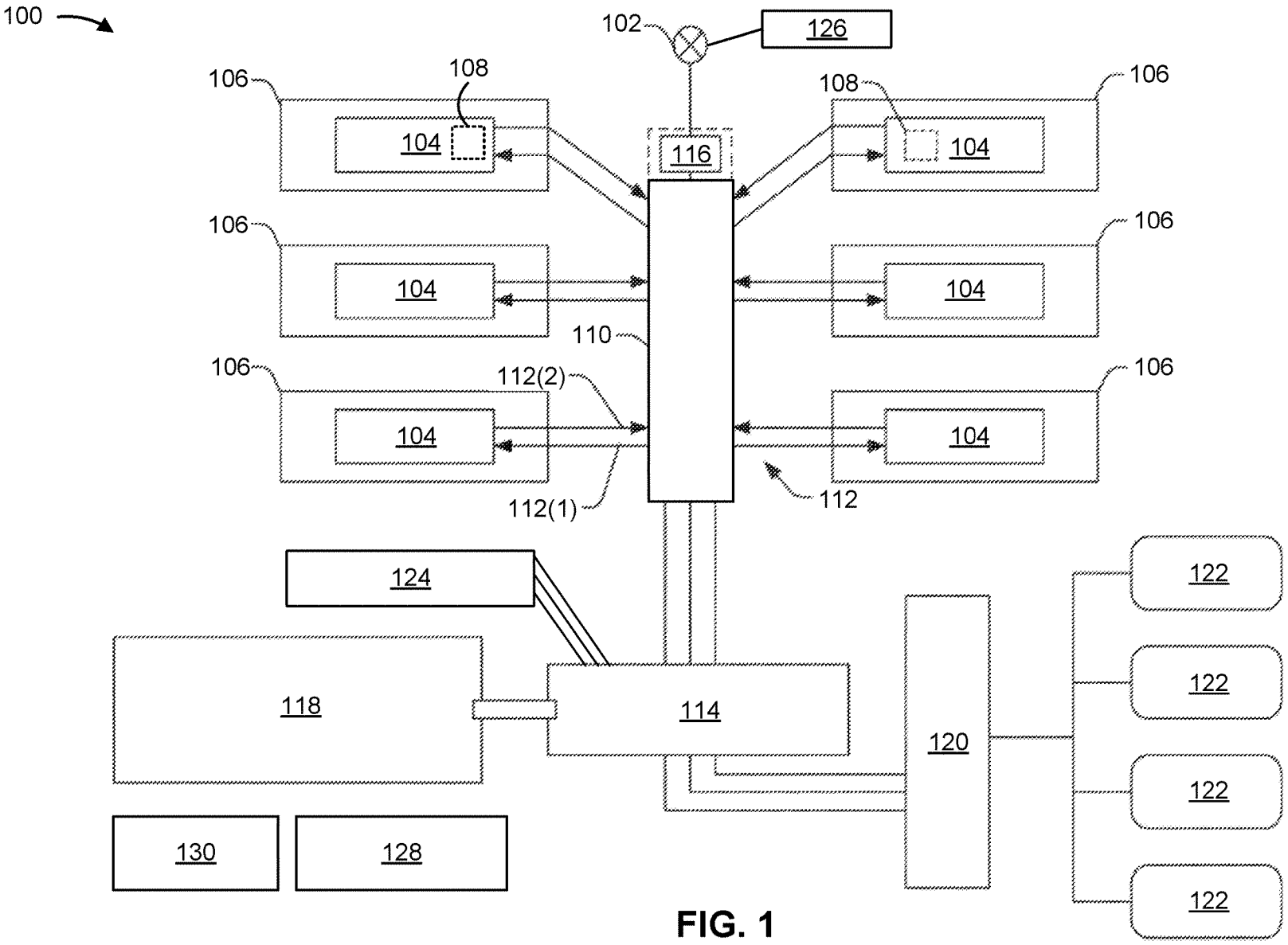
FIG. 1 is a diagram illustrating an example hydraulic fracturing system.

FIG. 1 is a diagram illustrating an example hydraulic fracturing system 100. For example, FIG. 1 depicts a plan view of an example hydraulic fracturing site along with equipment that is used during a hydraulic fracturing process. In some examples, less equipment, additional equipment, or alternative equipment to the example equipment depicted in FIG. 1 may be used to conduct the hydraulic fracturing process.

The hydraulic fracturing system 100 includes a well 102. Hydraulic fracturing is a well-stimulation technique that uses high-pressure injection of fracturing fluid into the well 102 and corresponding wellbore in order to hydraulically fracture a rock formation surrounding the wellbore. While the description provided herein describes hydraulic fracturing in the context of wellbore stimulation for oil and gas production, the description herein is also applicable to other uses of hydraulic fracturing.

High-pressure injection of the fracturing fluid may be achieved by one or more pump systems 104 that may be mounted (or housed) on one or more hydraulic fracturing trailers 106 (which also may be referred to as "hydraulic fracturing rigs") of the hydraulic fracturing system 100.

Each of the pump systems 104 includes at least one fluid pump 108 (referred to herein collectively, as "fluid pumps 108" and individually as "a fluid pump 108"). The fluid pumps 108 may be hydraulic fracturing pumps. The fluid pumps 108 may include various types of high-volume hydraulic fracturing pumps such as triplex or quintuplex pumps. Additionally, or alternatively, the fluid pumps 108 may include other types of reciprocating positive-displacement pumps or gear pumps. A type and/or a configuration of the fluid pumps 108 may vary depending on the fracture gradient of the rock formation that will be hydraulically fractured, the quantity of fluid pumps 108 used in the hydraulic fracturing system 100, the flow rate necessary to complete the hydraulic fracture, the pressure necessary to complete the hydraulic fracture, or the like. The hydraulic fracturing system 100 may include any number of trailers 106 having fluid pumps 108 thereon in order to pump hydraulic fracturing fluid at a predetermined rate and pressure.

In some examples, the fluid pumps 108 may be in fluid communication with a manifold 110 via various fluid conduits 112, such as flow lines, pipes, or other types of fluid conduits. The manifold 110 combines fracturing fluid received from the fluid pumps 108 prior to injecting the fracturing fluid into the well 102. The manifold 110 also distributes fracturing fluid to the fluid pumps 108 that the manifold 110 receives from a blender 114 of the hydraulic fracturing system 100. In some examples, the various fluids are transferred between the various components of the hydraulic fracturing system 100 via the fluid conduits 112. The fluid conduits 112 include low-pressure fluid conduits 112(1) and high-pressure fluid conduits 112(2). In some examples, the low-pressure fluid conduits 112(1) deliver fracturing fluid from the manifold 110 to the fluid pumps 108, and the high-pressure fluid conduits 112(2) transfer high-pressure fracturing fluid from the fluid pumps 108 to the manifold 110.

The manifold 110 also includes a fracturing head 116. The fracturing head 116 may be included on a same support structure as the manifold 110. The fracturing head 116 receives fracturing fluid from the manifold 110 and delivers the fracturing fluid to the well 102 (via a well head mounted on the well 102) during a hydraulic fracturing process. In some examples, the fracturing head 116 may be fluidly connected to multiple wells.

The blender 114 combines proppant received from a proppant storage unit 118 with fluid received from a hydration unit 120 of the hydraulic fracturing system 100. In some examples, the proppant storage unit 118 may include a dump truck, a truck with a trailer, one or more silos, or other types of containers. The hydration unit 120 receives water from one or more water tanks 122. In some examples, the hydraulic fracturing system 100 may receive water from water pits, water trucks, water lines, and/or any other suitable source of water. The hydration unit 120 may include one or more tanks, pumps, gates, or the like.

The hydration unit 120 may add fluid additives, such as polymers or other chemical additives, to the water. Such additives may increase the viscosity of the fracturing fluid prior to mixing the fluid with proppant in the blender 114. The additives may also modify a pH of the fracturing fluid to an appropriate level for injection into a targeted formation surrounding the wellbore. Additionally, or alternatively, the hydraulic fracturing system 100 may include one or more fluid additive storage units 124 that store fluid additives. The fluid additive storage unit 124 may be in fluid communication with the hydration unit 120 and/or the blender 114 to add fluid additives to the fracturing fluid.

In some examples, the hydraulic fracturing system 100 may include a balancing pump 126. The balancing pump 126 provides balancing of a differential pressure in an annulus of the well 102. The hydraulic fracturing system 100 may include a data monitoring system 128. The data monitoring system 128 may manage and/or monitor the hydraulic fracturing process performed by the hydraulic fracturing system 100 and the equipment used in the process. In some examples, the management and/or monitoring operations may be performed from multiple locations. The data monitoring system 128 may be supported on a van, a truck, or may be otherwise mobile. The data monitoring system 128 may include a display for displaying data for monitoring performance and/or optimizing operation of the hydraulic fracturing system 100. In some examples, the data gathered by the data monitoring system 128 may be sent off-board or off-site for monitoring performance and/or performing calculations relative to the hydraulic fracturing system 100.

The hydraulic fracturing system 100 includes a controller 130. The controller 130 may be a system-wide controller for the hydraulic fracturing system 100 or a pump-specific controller for a pump system 104. The controller 130 may be communicatively coupled (e.g., by a wired connection or a wireless connection) with one or more of the pump systems 104. The controller 130 may also be communicatively coupled with other equipment and/or systems of the hydraulic fracturing system 100. The controller 130 may include one or more memories and/or one or more processors.

As indicated above, FIG. 1 is provided as an example. Other examples may differ from what is described with regard to FIG. 1.

Figure 2:
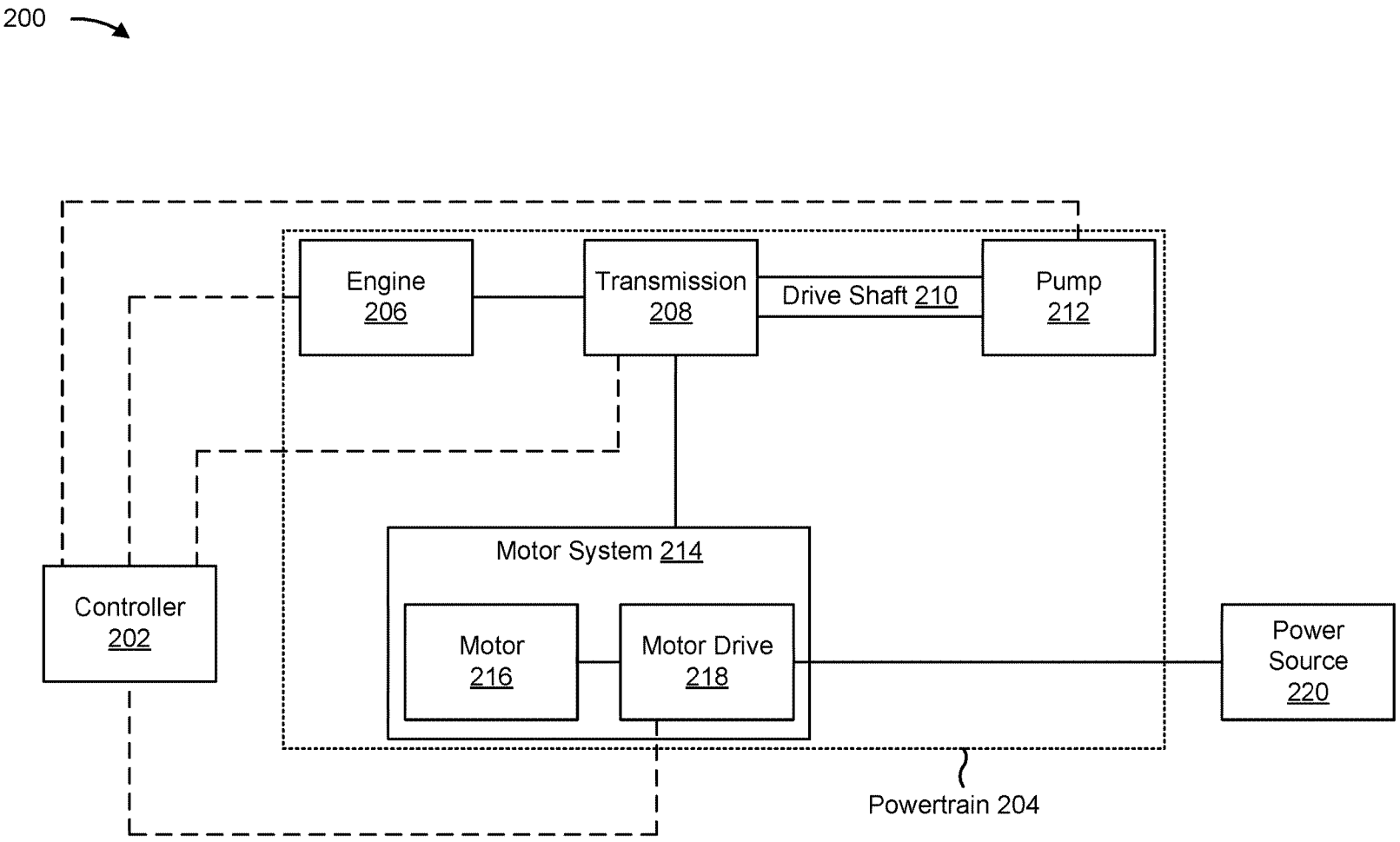
FIG. 2 is a diagram of an example pump system.

FIG. 2 is a diagram of an example pump system 200. In some implementations, the pump system 200 may correspond to a pump system 104, described herein. As shown, the pump system 200 includes a controller 202. The controller 202 may correspond to the controller 130, described herein. The controller 202 may be, or may be included in (e.g., with one or more other components of the pump system 200), a control system for the pump system 200. The pump system 200 includes a hybrid powertrain 204. The hybrid powertrain 204 includes an engine 206, a transmission 208, a driveshaft 210, a pump 212, and a motor system 214.

The engine 206 may be an internal combustion engine, such a gaseous fuel engine (e.g., an engine operable by spark ignition of a gaseous fuel) or another type of internal combustion engine (e.g., a diesel engine). The engine 206 may include a crankshaft (not shown) configured for rotation in the engine 206. The transmission 208 may be coupled (e.g., directly or indirectly coupled) to the engine 206 (e.g., to the crankshaft of the engine 206), and the driveshaft 210 may be coupled to the transmission 208. The pump 212 may be coupled to the driveshaft 210 for rotation with the driveshaft 210. Thus, the hybrid powertrain 204 is configured such that the pump 212 is driven by the driveshaft 210, which is driven by the engine 206 via the transmission 208.

Figure 3:
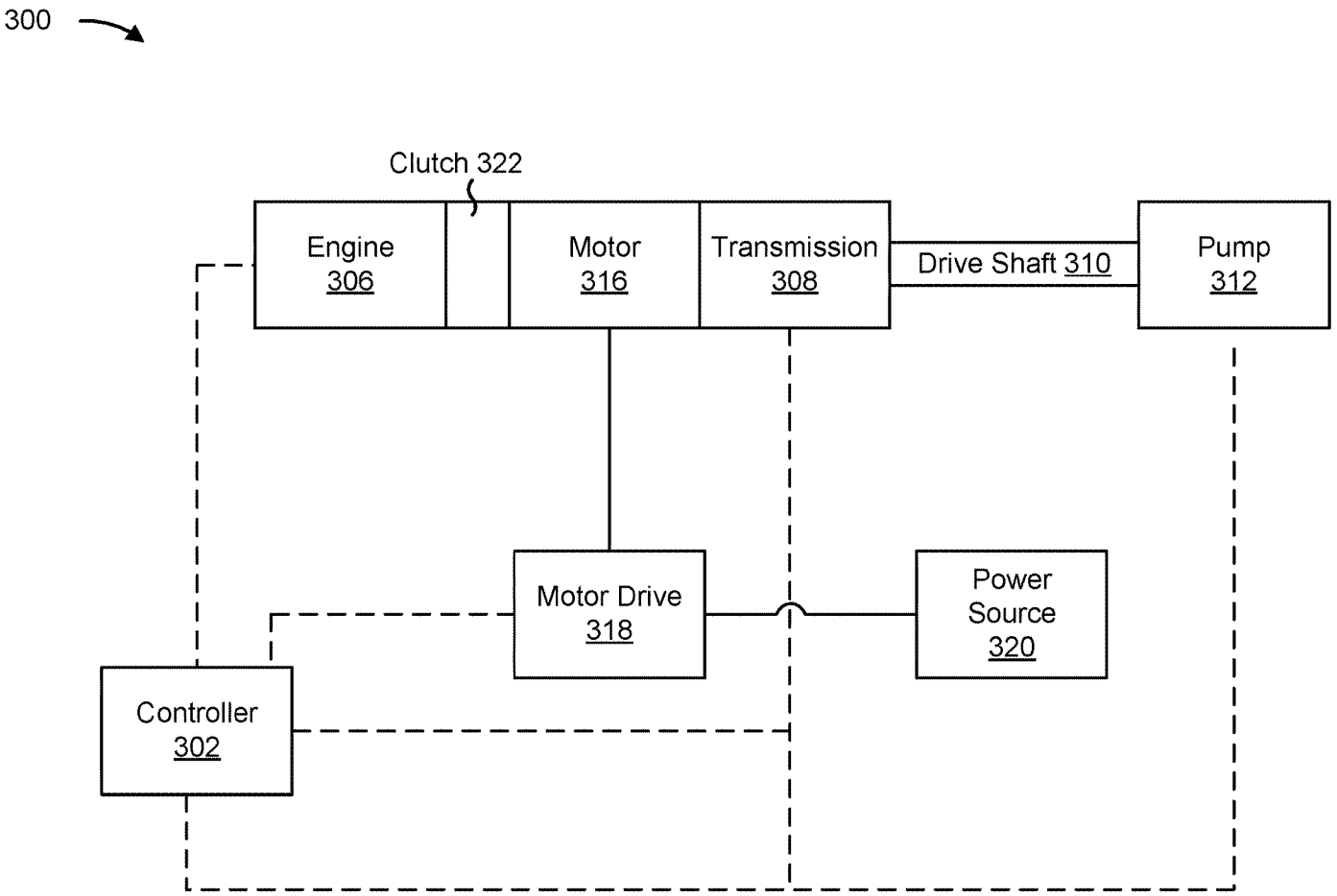
FIG. 3 is a diagram of an example pump system.
Figure 4:
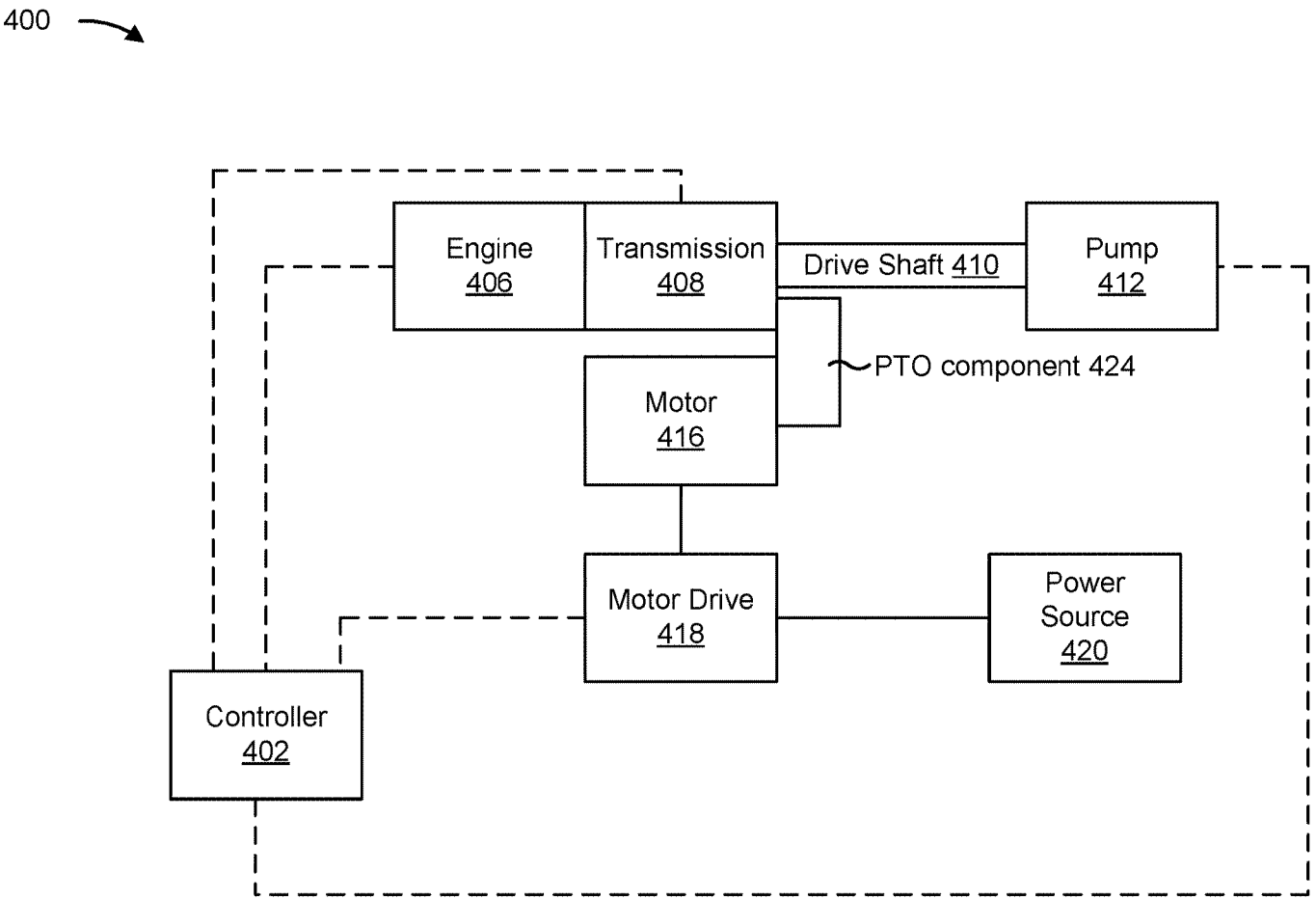
FIG. 4 is a diagram of an example pump system.
Figure 5:
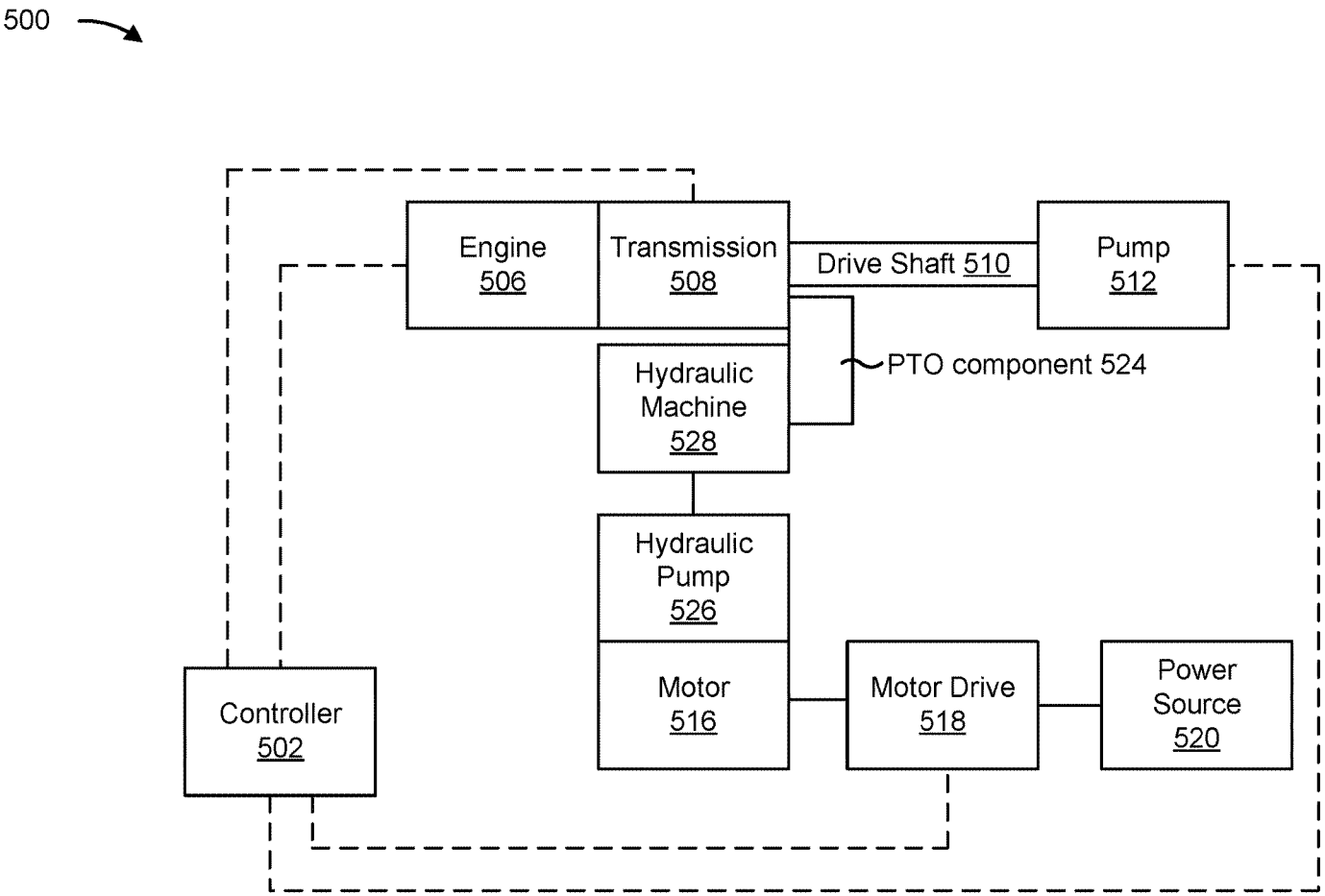
FIG. 5 is a diagram of an example pump system.

The motor system 214 may include a motor 216 and/or a motor drive 218 for the motor 216, as described further in connection with FIGS. 3-5. The motor 216 may be an electric motor, such as an induction motor, a synchronous motor, a permanent magnet synchronous motor (PMSM), or the like. The motor drive 218 may include a bi-directional rectifier-inverter, a variable frequency drive, or the like. The motor system 214 may be coupled to the pump 212 (e.g., via the transmission 208 and/or the driveshaft 210, or directly coupled to a gear of the pump 212), as described further in connection with FIGS. 3-5. The engine 206 and the motor system 214 may be arranged in series or in parallel to drive the pump 212, as described further in connection with FIGS. 3-5. Moreover, the motor system 214 may be configured to operate in a motor mode, in which the motor system 214 is producing torque and assists the engine 206 to drive the pump 212, and in a generator mode in which the motor system 214 brakes the engine 206 (e.g., the motor system 214 is driven by the engine 206) that is driving the pump 212 and generates current. The pump 212 may be a hydraulic fracturing pump. For example, the pump 212 may correspond to fluid pump 108, described herein.

The pump system 200 includes a power source 220 electrically connected to the motor system 214 (e.g., by one or more electrical lines). For example, the power source 220 may be electrically connected to the motor drive 218. The power source 220 may include a device or a system capable of providing electrical power to the motor system 214. For example, the power source 220 may be an energy storage system (ESS), such as one or more batteries, or grid power (e.g., a power source capable of quick dynamic power substitution and/or absorption during a highly transient event). In the motor mode of the motor system 214, the power source 220 provides electrical power to the motor system 214 (e.g., to power the motor 216). In the generator mode of the motor system 214, the motor system 214 provides electrical power to the power source 220 (e.g., the motor 216 operates as a generator).

The controller 202 may include one or more memories and/or one or more processors configured to perform operations in connection with controlling a hybrid mode of the pump system 200. The controller 202 may be communicatively coupled (shown by dashed lines) with the engine 206 (e.g., to exchange information relating to engine load demand), with the pump 212 (e.g., to exchange information relating to pump load demand), with the transmission 208 (e.g., to exchange information relating to a current gear or a gear shift), and/or with the motor drive 218 (e.g., to exchange information relating to a mode of the motor system 214 and/or a motor load demand). For example, the engine 206, the pump 212, the transmission 208, and/or the motor drive 218 may include a respective control or communication device (e.g., a controller) with which the controller 202 can communicate.

The controller 202 may determine whether the hybrid powertrain 204 is to use the hybrid mode (or to operate in an engine-only mode). The controller 202 may determine whether the hybrid powertrain 204 is to use the hybrid mode based on (e.g., based on an analysis of) a current mode used by the hybrid powertrain 204 (e.g., the hybrid mode or the engine-only mode), a current status of the engine 206 (e.g., a current speed of the engine 206, a current torque of the engine 206, and/or a current power output of the engine 206), and/or a state of charge (SOC) and/or a state of health (SOH) of the power source 220 (e.g., whether the SOC and/or the SOH satisfies a threshold). Based on a determination that the hybrid mode is to be used, the controller 202 may cause the hybrid powertrain 204 to continuously operate in the hybrid mode (e.g., the motor system 214 is either in the motor mode or in the generator mode at all times).

Based on a determination that the hybrid mode is to be used, the controller 202 may determine a torque distribution between the engine 206 and the motor system 214. For example, the engine 206 and the motor system 214 may operate continuously in the hybrid mode according to a continuously-adjusted torque distribution (e.g., the controller 202 may continuously (e.g., periodically) determine the torque distribution between the engine 206 and the motor system 214). In connection with determining the torque distribution, the controller 202 may detect whether a transient event is associated with the pump system 200 (e.g., whether the transient event is occurring or the transient event will occur). For example, the controller 202 may determine the torque distribution between the engine 206 and the motor system 214 based at least in part on whether the transient event is associated with the pump system 200. The transient event may include an event that causes a power output of the engine 206 to be too great or too little for a power requirement of the pump 212 (and/or an auxiliary load). For example, the transient event may include a change of pressure at a well (e.g., well 102) supplied by the pump 212 or at the pump 212, a change of a flow rate at the well or at the pump 212, and/or a gear shift of the transmission 208, among other examples.

The controller 202 may detect the transient event based on monitoring the well, the pump 212, and/or the transmission 208. If a transient event is detected, then the controller 202 may determine the torque distribution that is to be used during the transient event associated with the pump system 200. If no transient event is detected, then the controller 202 may determine the torque distribution that is to be used during steady state operation of the pump system 200. In other words, a torque distribution determined by the controller 202 for a transient event may be different from a torque distribution determined by the controller 202 for steady state operation.

The controller 202 may determine the torque distribution based on (e.g., based on an analysis of) a load associated with the engine 206 (e.g., associated with the hybrid powertrain 204), an auxiliary load associated with the engine 206 (e.g., associated with the hybrid powertrain 204), an SOC and/or an SOH of the power source 220, a current gear of the transmission 208, and/or a flow rate and/or a pressure at the pump 212, among other examples. For example, the controller 202 may determine a total torque requirement based on these variables. Furthermore, the controller 202 may determine the torque distribution in accordance with a first torque ability of the engine 206 (e.g., an ability during a transient event) and a second torque ability of the motor system 214 (e.g., an ability during a transient event).

In some implementations, the controller 202 may determine the torque distribution to achieve an optimal operation efficiency of the pump system 200 (e.g., which may be based on whether there is currently a change in flow rate and/or pressure at the well or the pump 212). For example, the optimal operation efficiency of the pump system 200 may balance optimizing an efficiency of the engine 206, an efficiency of the motor system 214, and an operational requirement of the SOC and/or SOH of the power source 220. As an example, in steady state operation, the controller 202 may cause increasing of engine torque to prioritize providing electrical power to the power source 220 (e.g., to charge an ESS). Whereas, for a transient event, the controller 202 may cause a total torque requirement to be split between the engine 206 and the motor system 214 based on their respective torque abilities. In some implementations, the controller 202 may determine the torque distribution to achieve a smooth transient behavior of the hybrid powertrain 204. For example, the controller 202 may cause a total torque requirement to be split between the engine 206 and the motor system 214 to maintain a steady flow rate and pressure at the pump 212.

The controller 202 may cause the engine 206 and/or the motor system 214 to operate according to the torque distribution. For example, the controller 202 may transmit a first torque indication to the engine 206 (e.g., indicating a torque demand for the engine 206) and/or the controller 202 may transmit a second torque indication to the motor drive 218 (e.g., indicating a torque demand for the motor system 214). The controller 202 may cause the engine 206 and/or the motor system 214 to operate according to the torque distribution such that the motor system 214 assists or brakes the engine 206 in driving the pump 212. For example, in steady state operation, the motor system 214 may assist the engine 206 in driving the pump 212, or the engine 206 may operate with excessive torque for the pump 212 load and the motor system 214 may brake the engine 206 in the generator mode of the motor system 214. As another example, during a transient event that causes a torque of the engine 206 to be insufficient for the pump 212, the motor system 214 may assist the engine 206 in driving the pump 212 (e.g., until the engine 206 is able to respond to the transient event). Conversely, during a transient event that causes a torque of the engine 206 to exceed a need of the pump 212, the motor system 214 may brake the engine in driving the pump 212 (e.g., the motor system 214 may operate in the generator mode).

In one example, during a downshift of the transmission 208, the torque distribution determined by the controller 202 may cause the motor system 214 to operate in the generator mode to brake excess load of the engine 206 and prevent engine 206 overspeed. Continuing with the example, during an upshift of the transmission 208, the torque distribution determined by the controller 202 may cause the motor system 214 to operate in the motor mode to assist the engine 206 in driving the pump 212 (e.g., where the torque distribution is based on a difference between a torque ability of the engine 206 and a torque requirement). In some implementations, based on a gear shift being commanded to the transmission 208, the controller 202 may cause performance of the gear shift after causing the motor system to operate according to the torque distribution.

As indicated above, FIG. 2 is provided as an example. Other examples may differ from what is described with regard to FIG. 2.

FIG. 3 is a diagram of an example pump system 300. The pump system 300 includes a controller 302, in a similar manner as described in connection with FIG. 2. The pump system 300 includes a powertrain including an engine 306, a transmission 308, a drive shaft 310, a pump 312, and a motor system that includes a motor 316 and a motor drive 318, in a similar manner as described in connection with FIG. 2. The pump system 300 includes a power source 320, in a similar manner as described in connection with FIG. 2.

As shown, the motor 316 may be coupled in series between the engine 306 and the transmission 308. For example, the transmission 308 may be coupled to the motor 316, and the motor 316 may be coupled to the engine 306 (e.g., to a crankshaft of the engine 306). The motor 316 may be coupled to the engine 306 via a clutch 322. Accordingly, in some examples, the clutch 322 may be disengaged from the motor 316 to facilitate driving the pump 312 in an electric-only mode (e.g., using the motor 316 without using the engine 306).

As indicated above, FIG. 3 is provided as an example. Other examples may differ from what is described with regard to FIG. 3.

FIG. 4 is a diagram of an example pump system 400. The pump system 400 includes a controller 402, in a similar manner as described in connection with FIG. 2. The pump system 400 includes a powertrain including an engine 406, a transmission 408, a drive shaft 410, a pump 412, and a motor system that includes a motor 416 and a motor drive 418, in a similar manner as described in connection with FIG. 2. The pump system 400 includes a power source 420, in a similar manner as described in connection with FIG. 2.

As shown, the motor 416 may be arranged in parallel with the engine 406. For example, the engine 406 may be coupled to the transmission 408, and the motor 416 may be coupled to the transmission 408 via a power take-off (PTO) component 424. The PTO component 424 may include a PTO gearbox, a PTO driveshaft, a PTO belt, or the like. Alternatively, the motor 416 may be coupled to the drive shaft 410 via a gearbox (not shown), or the motor 416 may be coupled to a gearbox or a drive system (not shown) of the pump 412. In some examples, the engine 406 may be turned off to facilitate driving the pump 412 in an electric-only mode using the motor 416 via the PTO component 424.

As indicated above, FIG. 4 is provided as an example. Other examples may differ from what is described with regard to FIG. 4.

FIG. 5 is a diagram of an example pump system 500. The pump system 500 includes a controller 502, in a similar manner as described in connection with FIG. 2. The pump system 500 includes a powertrain including an engine 506, a transmission 508, a drive shaft 510, a pump 512, and a motor system that includes a motor 516 and a motor drive 518, in a similar manner as described in connection with FIG. 2. The pump system 500 includes a power source 520, in a similar manner as described in connection with FIG. 2.

As shown, in addition to the motor 516 and the motor drive 518, the motor system may include a hydraulic pump 526 and a hydraulic machine 528. The motor 516 may be coupled to the hydraulic pump 526 to drive the hydraulic pump 526 (e.g., forming a motor-hydraulic pump combination). The motor 516 and the hydraulic pump 526 may share a housing or may be in separate housings. The hydraulic pump 526 may be fluidly connected to the hydraulic machine 528 (e.g., via one or more fluid conduits) to drive the hydraulic machine 528. The hydraulic machine 528 may include a hydraulic motor. The hydraulic machine 528 may be coupled to the transmission 508 via a PTO component 524, in a similar manner as described in connection with FIG. 4. Alternatively, the hydraulic machine 528 may be coupled to the drive shaft 410 via a gearbox (not shown), or the hydraulic machine 528 may be coupled to a gearbox or a drive system (not shown) of the pump 512. In some examples, the engine 506 may be turned off to facilitate driving the pump 512 in an electric-only mode using the hydraulic machine 528 via the PTO component 524.

As indicated above, FIG. 5 is provided as an example. Other examples may differ from what is described with regard to FIG. 5.

Figure 6:
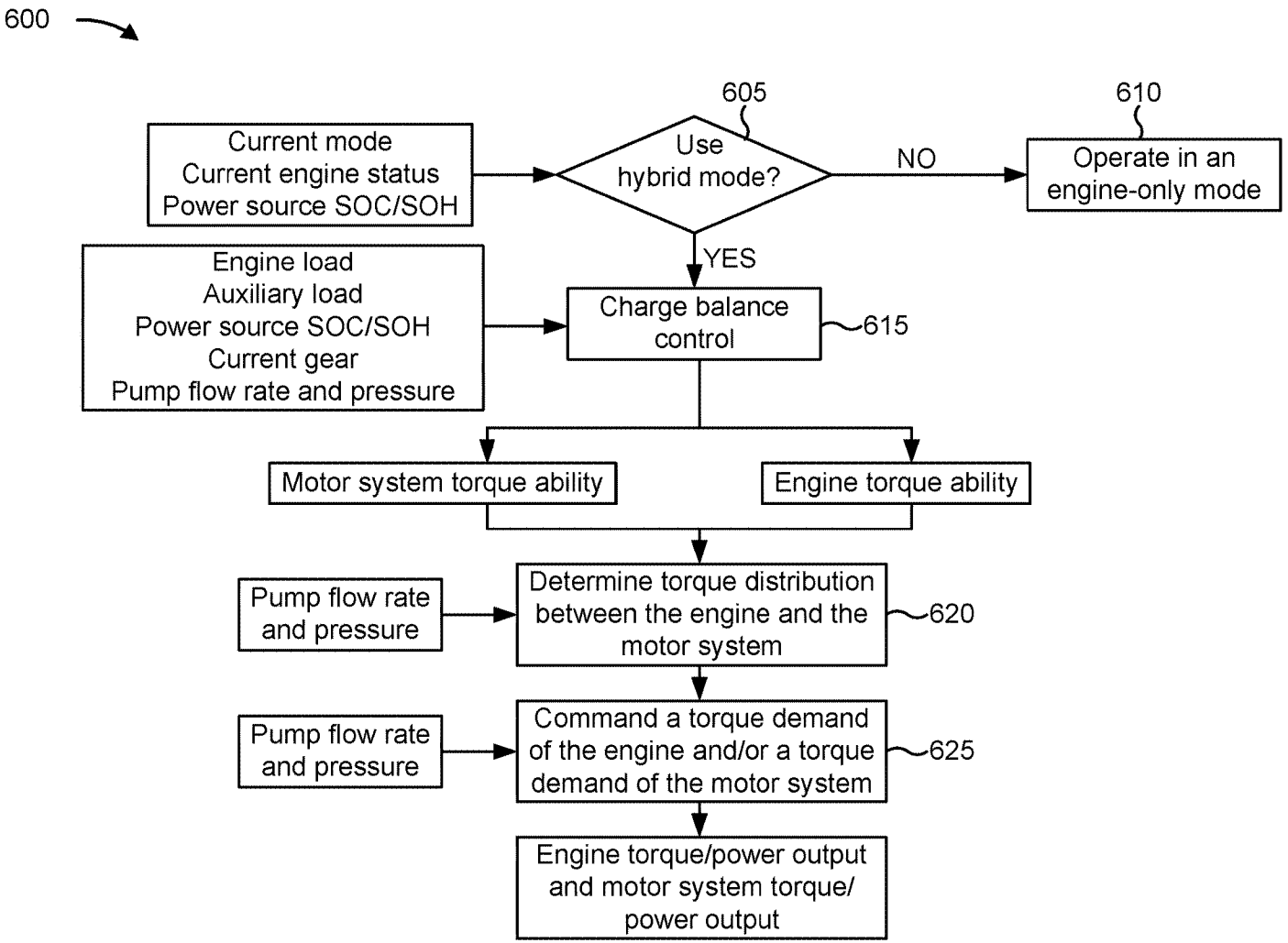
FIG. 6 is a flowchart of an example process associated with controlling a hybrid powertrain for a pump system.

FIG. 6 is a flowchart of an example process 600 associated with controlling a hybrid powertrain for a pump system. One or more process blocks of FIG. 6 may be performed by a controller (e.g., controller 130, controller 202, controller 302, controller 402, or controller 502).

Process 600 may include determining whether the hybrid powertrain is to use a hybrid mode (block 605). For example, the controller may determine whether the hybrid powertrain is to use the hybrid mode based on one or more inputs, such as a current mode used by the hybrid powertrain, a current status of an engine, and/or an SOC and/or an SOH of a power source, as described herein. Based on a determination that the hybrid powertrain is not to use the hybrid mode (block 605—NO), process 600 may include operating the hybrid powertrain in an engine-only mode (block 610). For example, the controller may set an engine-only mode flag to operate the hybrid powertrain in an engine-only mode.

Based on a determination that the hybrid powertrain is to use the hybrid mode (block 605—YES), process 600 may include performing charge balance control (block 615). The charge balance control may activate a motor mode or a generator mode for the motor system, may activate load splitting between the engine and the motor system, and/or may compute a torque requirement for the hybrid powertrain. For example, the controller may perform the charge balance control based on one or more inputs, such as a load associated with the engine, an auxiliary load associated with the engine, an SOC and/or an SOH of the power source, a current gear of a transmission, and/or a flow rate and/or a pressure at a pump, as described herein.

Process 600 may include determining a torque distribution between the engine and the motor system (block 620). For example, the torque distribution may be determined based on whether the motor mode or the generator mode is activated, load splitting being activated, and/or the torque requirement. As an example, the controller may determine the torque distribution based on one or more inputs, such as a torque ability of the motor system, a torque ability of the engine, and/or flow rates and pressures associated with the pump (e.g., over time), which may indicate a transient event (e.g., if the flow rates and pressures are changing over time). The torque distribution may be determined to achieve an optimal operation efficiency, as described herein.

Process 600 may include commanding a torque demand of the engine and/or commanding a torque demand of the motor system (block 625). As shown, the commanded torque demands may be for responding to current flow rates and pressures associated with the pump. Based on the commanded torque demands, the engine and the motor may provide respective torques and respective power outputs.

Although FIG. 6 shows example blocks of process 600, in some implementations, process 600 may include additional blocks, fewer blocks, different blocks, or differently arranged blocks than those depicted in FIG. 6. Additionally, or alternatively, two or more of the blocks of process 600 may be performed in parallel.

Figure 7:
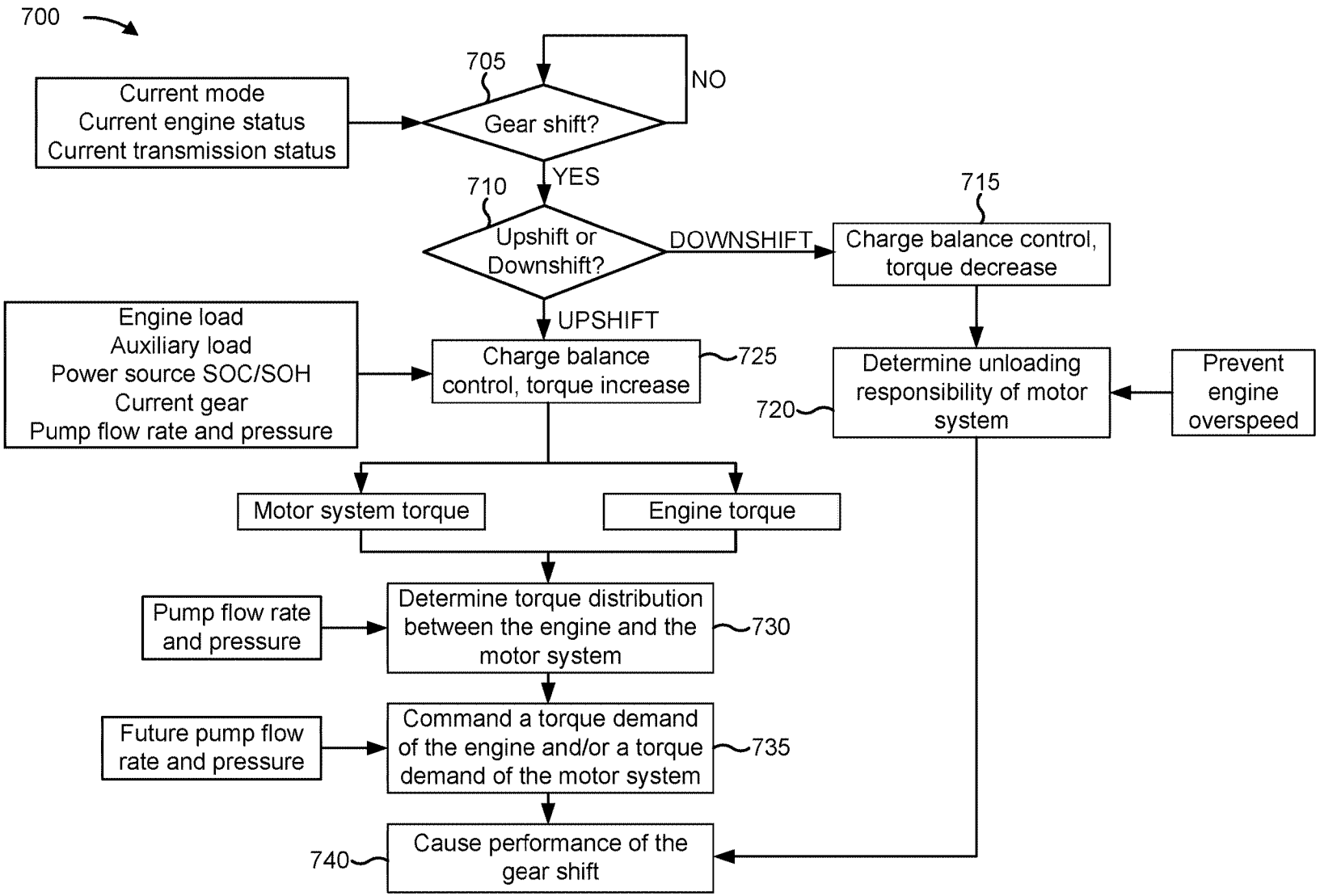
FIG. 7 is a flowchart of an example process associated with controlling a hybrid powertrain for a pump system.

FIG. 7 is a flowchart of an example process 700 associated with controlling a hybrid powertrain for a pump system. One or more process blocks of FIG. 7 may be performed by a controller (e.g., controller 130, controller 202, controller 302, controller 402, or controller 502).

Process 700 may include determining whether a gear shift of a transmission of the hybrid powertrain is to be performed (block 705). For example, the controller may determine whether the gear shift is to be performed based on one or more inputs, such as a current mode used by the hybrid powertrain, a current status of an engine (e.g., a current speed of the engine), and/or a current status of the transmission (e.g., a current gear of the transmission), as described herein. Based on a determination that the gear shift is not to be performed (block 705—NO), process 700 may include continuing to monitor whether the gear shift is to be performed. Based on a determination that the gear shift is to be performed (block 705—YES), process 700 may proceed based on whether the gear shift is an upshift or a downshift (block 710).

If the gear shift is a downshift (block 710—DOWNSHIFT), then process 700 may include performing charge balance control for a torque decrease (block 715), in a similar manner as described in connection with FIG. 6. Process 700 may include determining an unloading (e.g., braking) responsibility of a motor system (block 720). For example, the controller may determine the unloading responsibility of the motor system to prevent overspeed of the engine.

If the gear shift is an upshift (block 710—UPSHIFT), then process 700 may include performing charge balance control for a torque increase (block 725), in a similar manner as described in connection with FIG. 6. Process 700 may include determining a torque distribution between the engine and the motor system (block 730), in a similar manner as described in connection with FIG. 6. For example, the controller may determine the torque distribution based on one or more inputs, such as a torque of the motor system, a torque of the engine, and/or flow rates and pressures associated with the pump (e.g., over time), which may indicate a transient event (e.g., if the flow rates and pressures are changing over time). The torque distribution may be determined to achieve a smooth transient behavior of the hybrid powertrain, as described herein. Process 700 may include commanding a torque demand of the engine and/or commanding a torque demand of the motor system (block 735). As shown, the commanded torque demands may be for responding to future flow rates and pressures associated with the pump (e.g., due to the gear shift).

Process 700 may include causing performance of the gear shift (block 740). For example, the controller may cause the transmission to perform the gear shift (e.g., by commanding the transmission to shift gears).

Although FIG. 7 shows example blocks of process 700, in some implementations, process 700 may include additional blocks, fewer blocks, different blocks, or differently arranged blocks than those depicted in FIG. 7. Additionally, or alternatively, two or more of the blocks of process 700 may be performed in parallel.

Figure 8:
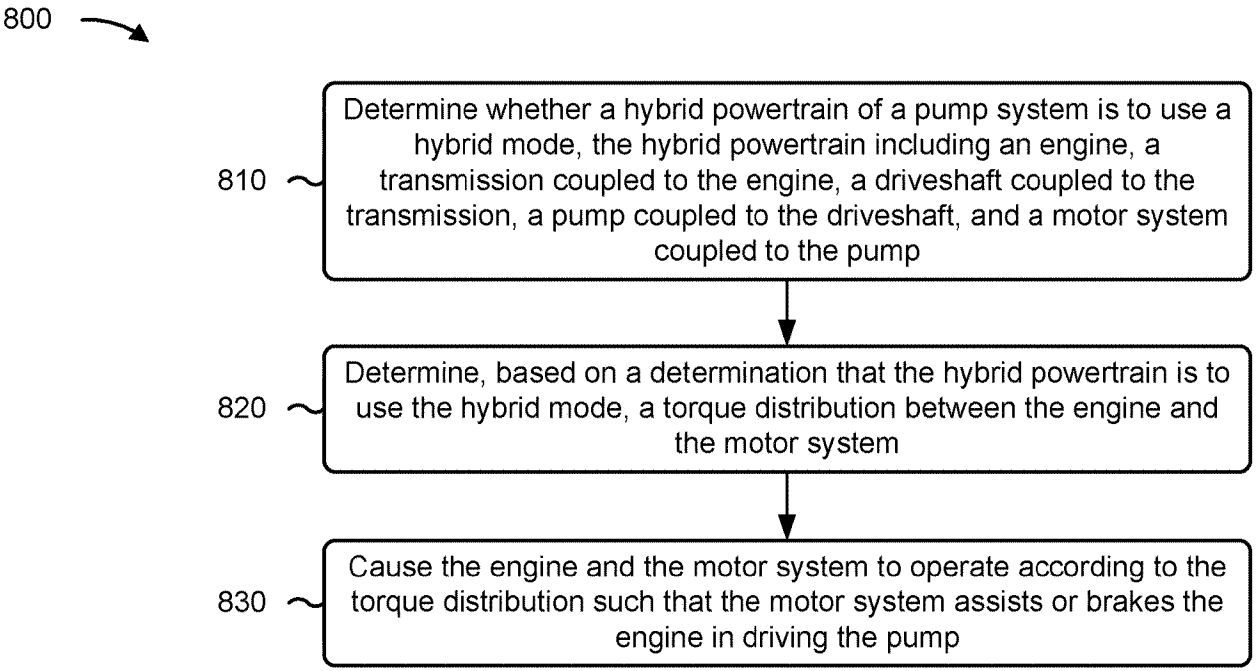
FIG. 8 is a flowchart of an example process associated with controlling a hybrid powertrain for a pump system.

FIG. 8 is a flowchart of an example process 800 associated with controlling a hybrid powertrain for a pump system. One or more process blocks of FIG. 8 may be performed by a controller (e.g., controller 130, controller 202, controller 302, controller 402, or controller 502). Additionally, or alternatively, one or more process blocks of FIG. 8 may be performed by another device or a group of devices separate from or including the controller, such as another device or component that is internal or external to pump system 200.

As shown in FIG. 8, process 800 may include determining whether a hybrid powertrain of a pump system is to use a hybrid mode (block 810). For example, the controller (e.g., using one or more memories and/or one or more processors) may determine whether a hybrid powertrain of a pump system is to use a hybrid mode, as described above. The hybrid powertrain may include an engine, a transmission coupled to the engine, a driveshaft coupled to the transmission, a pump coupled to the driveshaft, and a motor system coupled to the pump, as described above. Determining whether the hybrid powertrain of the pump system is to use the hybrid mode may include determining whether the hybrid powertrain of the pump system is to use the hybrid mode based on at least one of an SOC or an SOH of a power source for the motor system.

As further shown in FIG. 8, process 800 may include determining, based on a determination that the hybrid powertrain is to use the hybrid mode, a torque distribution between the engine and the motor system (block 820). For example, the controller (e.g., using one or more memories and/or one or more processors) may determine, based on a determination that the hybrid powertrain is to use the hybrid mode, a torque distribution between the engine and the motor system, as described above. Determining the torque distribution may include determining the torque distribution based on one or more of a load associated with the engine, an auxiliary load associated with the engine, at least one of an SOC or an SOH of a power source for the motor system, a current gear of the transmission, or at least one of a flow rate or a pressure at the hydraulic fracturing pump. Additionally, or alternatively, determining the torque distribution may include determining the torque distribution based at least in part on a first torque ability of the gaseous fuel engine and a second torque ability of the motor system.

Process 800 may include detecting a transient event, where the torque distribution between the gaseous fuel engine and the motor system is to be used during the transient event.

As further shown in FIG. 8, process 800 may include causing the engine and the motor system to operate according to the torque distribution such that the motor system assists or brakes the engine in driving the pump (block 830). For example, the controller (e.g., using one or more memories and/or one or more processors) may cause the engine and the motor system to operate according to the torque distribution such that the motor system assists or brakes the engine in driving the pump, as described above. In some implementations, the transient event is a gear shift of the transmission, and process 800 may include causing performance of the gear shift of the transmission after causing the engine and the motor system to operate according to the torque distribution. The engine and the motor system may operate continuously in the hybrid mode according to a continuously-adjusted torque distribution.

Although FIG. 8 shows example blocks of process 800, in some implementations, process 800 may include additional blocks, fewer blocks, different blocks, or differently arranged blocks than those depicted in FIG. 8. Additionally, or alternatively, two or more of the blocks of process 800 may be performed in parallel.

INDUSTRIAL APPLICABILITY

The control system described herein may be used with any pump system having a pump and a hybrid powertrain for driving the pump. For example, the pump may be a hydraulic fracturing pump used for pumping hydraulic fracturing fluid into a wellbore. The hybrid powertrain may include a motor system and an engine, such as a gaseous fuel engine, that has a slow torque or power response to a transient event (e.g., a gear shift) that affects a flow rate and a pressure produced by the pump. This slow transient response of the engine may result in a pressure drop that can disrupt or impair hydraulic fracturing operations, or result in overspeed of the engine that can damage the engine or otherwise cause engine malfunction.

The control system is useful for distributing torque between the engine and the motor system during a transient event associated with the hybrid powertrain or during steady state operation of the hybrid powertrain. For example, the control system may determine a torque distribution for the engine and the motor system such that the motor system assists or brakes the engine in driving the pump. Use of the motor system to brake the engine may enable the motor system to operate as an electrical generator to provide electrical power to a power source (e.g., an ESS) for the motor system.

In some examples, the torque may be distributed to achieve an optimal operation efficiency of the pump system that balances optimizing an efficiency of the engine, an efficiency of the motor system, and an SOC and/or SOH of the power source. Additionally, or alternatively, the torque may be distributed to achieve smooth behavior of the hybrid powertrain during a transient event. In this way, the pump may be operated with negligible or no interruption, and engine overspeed may be prevented, in both steady state and transient conditions.

The foregoing disclosure provides illustration and description, but is not intended to be exhaustive or to limit the implementations to the precise forms disclosed. Modifications and variations may be made in light of the above disclosure or may be acquired from practice of the implementations. Furthermore, any of the implementations described herein may be combined unless the foregoing disclosure expressly provides a reason that one or more implementations cannot be combined. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

As used herein, "a," "an," and a "set" are intended to include one or more items, and may be used interchangeably with "one or more." Further, as used herein, the article "the" is intended to include one or more items referenced in connection with the article "the" and may be used interchangeably with "the one or more." Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of").

What is claimed is:

1. A pump system, comprising:

a hybrid powertrain, comprising:

a gaseous fuel engine;

a transmission coupled to the gaseous fuel engine;

a driveshaft coupled to the transmission;

a hydraulic fracturing pump coupled to the driveshaft; and a motor system coupled to the hybrid powertrain;

a power source electrically connected to the motor system; and a controller configured to:

cause the hybrid powertrain to operate in a hybrid mode;

monitor, based on causing the hybrid powertrain to operate in the hybrid mode, a flow rate or a pressure of the hydraulic fracturing pump;

continuously adjust, in the hybrid mode, a torque distribution between the gaseous fuel engine and the motor system to maintain the flow rate or the pressure of the hydraulic fracturing pump steady by causing the gaseous fuel engine and the motor system to operate according to a first torque distribution, based at least in part on the flow rate or the pressure of the hydraulic fracturing pump, including the motor system assisting the gaseous fuel engine in driving the hydraulic fracturing pump and the motor system braking the gaseous fuel engine in driving the hydraulic fracturing pump;

based on a determination that an upshift of the transmission is to be performed, while continuously adjusting the torque distribution between the gaseous fuel engine and the motor system, cause the gaseous fuel engine and the motor system to operate according to a second torque distribution, based at least in part on the flow rate or the pressure of the hydraulic fracturing pump, including the motor system assisting the gaseous fuel engine in driving the hydraulic fracturing pump; and cause performance of the upshift after causing the gaseous fuel engine and the motor system to operate according to the second torque distribution.

2. The pump system of claim 1, wherein the power source is an energy storage system or grid power.

3. The pump system of claim 1, wherein the controller is further configured to:

determine the torque distribution based on the flow rate.

4. The pump system of claim 1, wherein the motor system comprises a motor and a motor drive for the motor.

5. The pump system of claim 1, wherein the motor system comprises an electric motor, and wherein the electric motor is coupled in series between the gaseous fuel engine and the transmission.

6. The pump system of claim 5, wherein the electric motor is coupled to the gaseous fuel engine via a clutch.

7. The pump system of claim 1, wherein the motor system comprises an electric motor, and wherein the electric motor is coupled to the transmission via a power take-off component, and the electric motor is mechanically or fluidly coupled to the power take-off component.

8. The pump system of claim 1, wherein the motor system comprises:

a hydraulic machine;

a hydraulic pump to drive the hydraulic machine; and an electric motor to drive the hydraulic pump, wherein the hydraulic machine is coupled to the transmission via a power take-off component.

9. The pump system of claim 1, wherein the motor system is configured to provide electrical power to the power source when braking the gaseous fuel engine.

10. A pump system, comprising:

a hybrid powertrain, comprising:

a gaseous fuel engine;

a transmission coupled to the gaseous fuel engine;

a driveshaft coupled to the transmission;

a hydraulic fracturing pump coupled to the driveshaft; and a motor system, coupled to the hydraulic fracturing pump, comprising:

a hydraulic machine;

a hydraulic pump to drive the hydraulic machine; and an electric motor to drive the hydraulic pump, wherein the hydraulic machine is coupled to the transmission via a power take-off component;

a power source electrically connected to the motor system; and a controller configured to:

determine a torque distribution between the gaseous fuel engine and the motor system based at least in part on whether a transient event is associated with the pump system; and cause the gaseous fuel engine and the motor system to operate according to the torque distribution such that the motor system assists or brakes the gaseous fuel engine in driving the hydraulic fracturing pump.

11. The pump system of claim 10, wherein the power source is an energy storage system or grid power.

12. The pump system of claim 10, wherein the controller, to determine the torque distribution, is configured to:

determine the torque distribution based on one or more of:

a load associated with the gaseous fuel engine, an auxiliary load associated with the gaseous fuel engine, at least one of a state of charge or a state of health of the power source, a current gear of the transmission, or at least one of a flow rate or a pressure at the hydraulic fracturing pump.

13. The pump system of claim 10, wherein the motor system is configured to provide electrical power to the power source when braking the gaseous fuel engine.

* * * * *